United States Patent [19]

Stern

[11] Patent Number: 4,961,537

[45] Date of Patent: Oct. 9, 1990

[54] PRESSURE OPERATED SPRAY APPLICATOR

[75] Inventor: Donald J. Stern, Bellingham, Wash.

[73] Assignee: DJS & T Limited Partnership, Bellingham, Wash.

[21] Appl. No.: 413,786

[22] Filed: Sep. 28, 1989

[51] Int. Cl.[5] ..... B05B 7/30

[52] U.S. Cl. ..... 239/348; 239/526; 239/412

[58] Field of Search ..... 239/345, 346, 347, 348, 239/525, 526, 411, 412, 416, 416.4, 416.5, 424, 654; 251/33

[56] References Cited

U.S. PATENT DOCUMENTS

| | | | |
|---|---|---|---|
| 1,162,170 | 11/1915 | Johnson | 251/33 X |
| 1,332,544 | 3/1920 | Davis . | |
| 1,609,465 | 12/1926 | Day . | |
| 1,656,132 | 1/1928 | Arrasmith et al. | 251/33 X |
| 3,207,444 | 9/1965 | Kelley et al. | 239/347 X |
| 3,491,951 | 1/1970 | Knibb | 239/346 |
| 3,647,143 | 3/1972 | Gauthier et al. | 239/347 X |
| 3,987,811 | 10/1976 | Finger | 251/33 X |
| 4,058,287 | 11/1977 | Fromfield | 251/33 X |
| 4,411,387 | 10/1983 | Stern et al. | 239/345 |
| 4,685,622 | 8/1987 | Shimorhira et al. | 239/348 X |

FOREIGN PATENT DOCUMENTS

| | | | |
|---|---|---|---|
| 508734 | 3/1939 | United Kingdom | 239/348 |

*Primary Examiner*—Andres Kashnikow
*Assistant Examiner*—Kevin P. Weldon
*Attorney, Agent, or Firm*—Hughes & Multer

[57] ABSTRACT

A manually operated spray applicator to deposit plaster or the like against a wall surface in a spray pattern. There is a forward containing chamber for the plaster, a rear pressurizing chamber to supply the pressurized air through a discharge stem, and an intermediate positioning chamber having a moveable piston which moves the discharge stem between its open and closed positions. There is a control valve which is operable by a trigger which selectively vents a bypass passageway that pressurizes the positioning chamber to move the discharge stem between its open and closed positions.

10 Claims, 4 Drawing Sheets

PRESSURE OPERATED SPRAY APPLICATOR

BACKGROUND OF THE INVENTION

1. Field of the Invention

The present invention relates, generally, to compression spray applicators for coating fluids, and more particularly such a spray applicator for spraying viscous fluids, such as plaster or other texturizing materials onto a wall, ceiling or the like.

2. Background Art

One problem in such applicators, and particularly when dealing with the application of plaster or similar materials, is that when the spray operation first begins, and oftentimes at its termination, there is the problem of the material "dribbling" during the startup, and also at the time when the fluid flow is terminated. One means of solving this is to have the discharge stem positioned against the discharge opening through which the plaster or other material is sprayed. The pressurized air is first caused to move through a central passageway in the discharge stem and out the forward exit end thereof, after which the stem is moved rearwardly from the discharge opening to permit the plaster or the like to flow into the air jet to be sprayed from the discharge opening. Also, upon termination of the particular spray application, the discharge stem is caused to again seal against the discharge opening while air is still being discharged through the stem, so as to prevent the dribbling at the end of the operation.

There are various examples in the prior art showing this general mode of operation. For example, U.S. Pat. No. 1,609,465 shows a paint sprayer where the paint is supplied to a spray gun through a first passageway and pressurized air through another. When an operating trigger is depressed, the portion of the pressurized air activates a diaphragm which is moved rearwardly against the force of a biasing spring which would normally maintain a valve member in a closed position. As the valve member moves rearwardly, it opens the spray nozzle so paint can flow from the reservoir into the air stream. Thus, there is an issuance of the propelling air through the nozzle for a very short time period immediately prior to the movement of the diaphragm and likewise causes the air to flow for a slight time period after the force of the diaphragm is released, to ensure that all the paint is atomized, and thus prevent unwanted spattering.

A similar approach is shown in U.S. Pat. No. 1,332,554. This also shows a spray gun used for depositing paints or other coatings. Air is admitted through one passageway and the paint or other fluid via another passageway. The stem through which the air is discharged is initially sealed against the discharge port of a chamber containing the paint or other material. When pressurized air is delivered into the device, the stem is retracted by action of the air pressure against a biasing string so that the paint may be propelled by the air stream through the port. Both this patent and the patent mentioned immediately above have a handle which can be grasped in the hand, as well as an operating trigger.

U.S. Pat. No. 4,411,387 shows a manually operated spray applicator, one of the co-inventors in that patent, Donald J. Stern, being the inventor in the present application. This shows a spray applicator where there a manually operated piston to supply the pressurized air. The piston is moved forwardly to pressurize a rear main pressure chamber to cause air to flow through a discharge stem that is seated so as to close a discharge port for the plaster or the material. There is a bypass passageway leading from the main pressure chamber to a secondary pressure chamber where there is a control piston that is fixably connected to the discharge stem. As air flows through this bypass passageway, it pressurizes the second pressure chamber to move the stem rearwardly away from its seat, against the urging of a biasing spring, so as to permit the plaster or the material to flow into the region of the port, with the air jet causing this to be discharged in the form of a spray. When the manually operated pressure piston passes a certain location in the main pressure chamber, the bypassed passageway is exposed to ambient air to release pressure in the secondary pressure chamber and cause the discharge stem to move to its forward position to close the discharge port.

SUMMARY OF THE INVENTION

The spray applicator of the present invention is arranged to discharge a fluid material in a spray pattern by means of pressurized air. The applicator comprise a housing having a front and a rear end. The housing comprises:

a. a front wall and a first intermediate wall positioned rearwardly of the front wall, with these defining a front fluid containing chamber, and with the front wall having a front discharge opening leading from the fluid containing chamber.

b. a second intermediate wall positioned rearwardly of the first intermediate wall, and defining with the first intermediate wall a secondary pressurizing chamber; and c. a third rear wall positioned rearwardly of the second intermediate wall, and defining therewith a main pressurizing chamber which is located rearwardly of the secondary pressurizing chamber.

There is a discharge stem defining a through air passageway and having a front outlet end and rear inlet end. The discharge stem has a forward portion positioned in the containing chamber, and a rear portion extending through the first and second intermediate walls, in a manner so as to be moveable in a forward to rear direction.

There is a locating piston means being fixedly secured to the discharge stem and being positioned in the secondary pressurizing chamber so as to be moveable from a forward closure position at which the front end of the discharge stem closes the front discharge opening from the containing chamber, and a rear position where the front end of the discharge stem is spaced rearwardly of the outlet opening of the containing chamber.

A bypass passageway is provided, this having a first end leading to the main pressurizing chamber and a second end connecting to a forward portion Of the secondary pressurizing chamber. Thus, pressurized air in the main pressurizing chamber is able to flow through the bypass passageway into the secondary pressurizing chamber forwardly of the locating piston. A spring means is operatively connected between the discharge stem and the housing to urge the discharge stem forwardly into the closed position. Further, there is means to deliver pressurized air into the main pressurizing chamber.

The spring means, the locating piston, and the bypass passageway are arranged in a manner that when a predetermined level of pressure is reached in the main pressurizing chamber, air pressure transmitted into the secondary pressurizing chamber forwardly of the locating piston is sufficient to overcome a force exerted by the spring means to cause the discharge stem to move rearwardly so that the forward end of the discharge stem moves away from the discharges opening leading from the containing chamber.

There is operator actuated pressure control valve means which is operatively connected to the bypass passageway means and to the main pressurizing chamber. The valve means has a first position by which pressurized air flows from the main pressurizing chamber, through said bypass passageway means and to the forward portion of the secondary pressurizing chamber to cause the discharge stem to move rearwardly. Also, pressurized air flows from the main pressurizing chamber through the air passageway of the discharge stem. The valve means has a second position where air in the forward portion of the secondary pressurizing chamber is vented to reduce pressure in the forward portion of the secondary pressurizing chamber, while any flow from the main pressurizing chamber is sufficiently limited so that a pressure level in the main pressurizing chamber is sufficiently high to maintain the flow of pressurized air through the discharge stem.

Thus, when pressurized air flows into the pressurizing chamber, with the valve means in the first position, there is an immediate outflow of air through the air passageway in the discharge stem, and also pressurized air flows through the valve means and through the bypass passageway into the forward portion of the secondary pressurizing chamber and reaches a level to cause rearward movement of the locating piston and the stem, so as to permit fluid in the containing chamber to pass into an air stream passing by the discharge stem and be discharged into the air stream through the discharge opening. When the valve means is moved to the second position, air is vented from the forward portion of the secondary pressurizing chamber so as to reduce pressure in the forward portion of the secondary containing chamber so that the locating piston and the discharge stem move forwardly so that the front end of the discharge stem closes the front discharge opening from the containing chamber while pressurized air continues to flow from the main pressurizing chamber through the discharge stem and out the front outlet of the stem.

In the preferred form, the pressure control means comprises a first pressurizing port means leading from the main pressurizing chamber to the bypass passageway means, and also comprises second vent port means leading from the bypass passageway means to a venting location. Further, there is a valve element means having a first closed position relative to the vent port means to prevent pressurized air from the bypass passageway means passing outwardly through the vent port means, and a second position opening said vent port means to the venting location to permit pressurized air to flow from said bypass passageway means to the venting location. The pressurizing port means has a smaller cross-sectional flow area relative to the vent port means, with the pressurizing port means and the vent port means communicating with a valve chamber having a flow connection with the bypass passageway means. Thus, with the valve element means being in the second position, outflow through the vent port means is able to exceed inflow through the pressurizing port means so that pressure in said valve chamber is reduced.

Also, there is a manually operated trigger means which is moveable between first and second trigger positions to engage the valve element means and cause movement thereof as described above.

There are other embodiments of the valve means. In a second embodiment, the valve element means has a position closing the first port and a second position opening the first port.

In a third embodiment, which is similar to the second embodiment, with the valve element means in the second position, the second port is closed.

In a fourth embodiment, there is a moveable valve element positioned in the valve housing which in the first position connects the bypass passageway with the first port, and a second position connecting the bypass passageway means with a second port.

Other features will become apparent from the following detailed description.

DESCRIPTION OF THE PREFERRED EMBODIMENT

Figure 1:
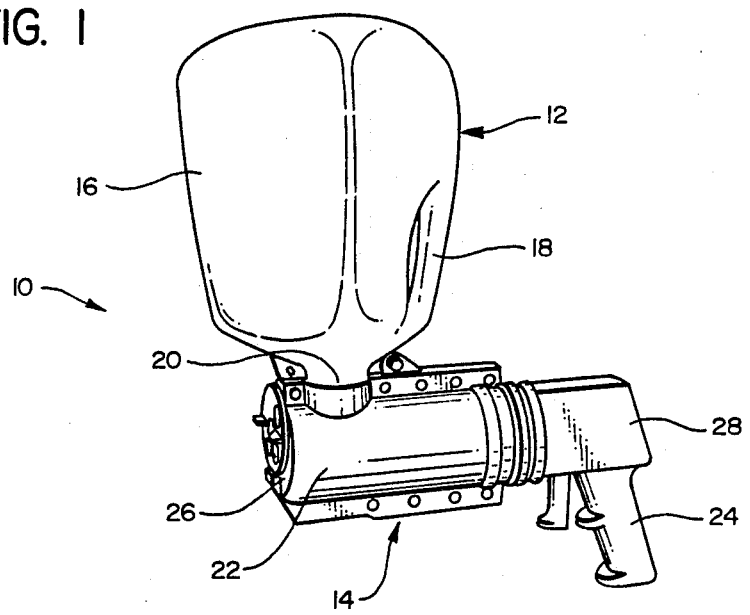
FIG. 1 is an isometric view of the spray applicator of the present invention.

In the following description, the fluid or liquid which is to be discharged from the spray applicator can be a variety of materials, and for ease of description, this will simply be referred to as "plaster," it being understood that liquids other than plaster could also be sprayed from this apparatus.

The spray applicator 10 of the present invention comprises a storage bottle 12 and an applicator section 14 which will hereinafter be referred to as the applicator gun 14 or simply the gun 14 (since this has a pistol like configuration). The storage bottle 10 has a main containing section 16 and a rearwardly facing handle 18. This bottle 12 is adapted to be positioned in an inverted position so that its discharge opening 20 opens downwardly to supply the plaster to the gun 14.

The gun 14 comprises a main housing 22 and a handle 24. This housing 22 has a generally cylindrical configuration. It has a forward discharge end 26 and a rear end 28. In terms of function, the housing 22 is divided into four chambers; namely, a forward plaster containing chamber 30, a main pressurizing chamber 32, a secondary pressurizing chamber 34 (positioned between the chambers 30 and 32), and a rear operating chamber 36.

Figure 2:
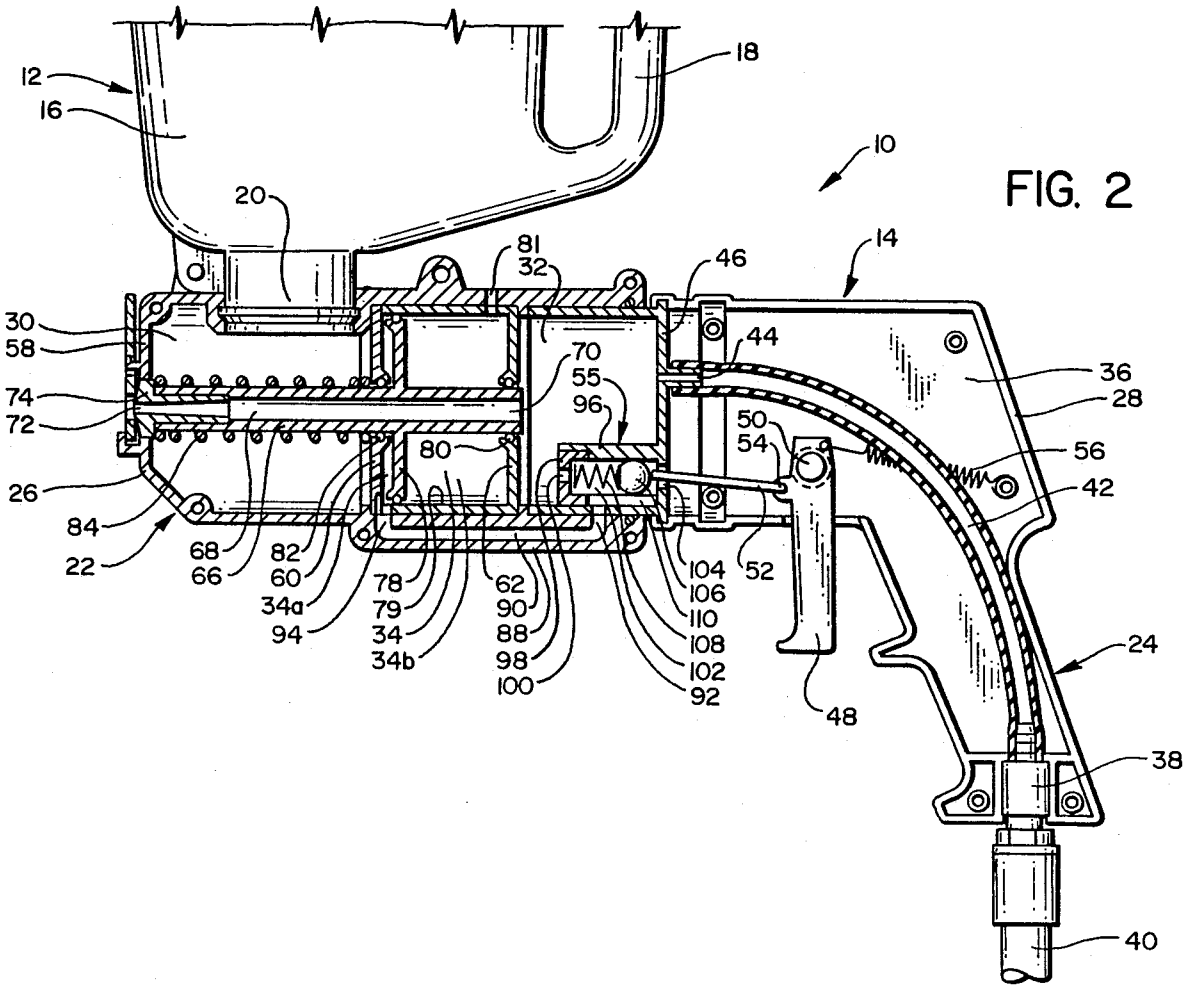
FIG. 2 is a sectional view taken along the longitudinal center line of the applicator portion of the apparatus; showing the bypass passageway unvented and the valve stem in the unseated position.

Mounted to the bottom end of the gun handle 24 is a fitting 38 which connects to an exterior air hose 40 that in turn connects to a source of pressurized air (not shown). A flexible air conduit 42 connects to this fitting 38 and extends upwardly through the interior of the gun handle 34 and through the rear operating chamber 36 to connect to a nipple or fitting 44 that is formed in a wall 46 that defines the rear end of the aforementioned main pressurizing chamber 32. The exterior air hose 40 can be connected to a source of pressurized air, such as a standard commercial air compressor. There is provided a trigger 48 which is pivotally mounted at 50 and has a forwardly facing finger 52 pivotally mounted to the trigger at 54. This trigger is used to operate a valve mechanism 55 which is particularly significant in the present invention and which will be described later herein. A tension spring 56 is connected to the trigger 48 to urge the trigger toward its forward position, as shown in FIG. 2.

To turn our attention now to the housing 22, the main pressurizing chamber 32 is defined by the a front wall 58 of the housing 22 and a first intermediate wall 60 positioned rearwardly at the front wall 58. The intermediate secondary pressurizing chamber 34 is defined by the first intermediate wall 60 and a second intermediate wall 62 spaced a short distance rearwardly of the wall 60. Then there is the third rear interior wall 46 (to which the nipple or fitting 44 is mounted, with this wall 46 and the wall 62 defining the aforementioned main pressurizing chamber).

Positioned within the forward part of the housing 22 is a discharge stem 66 defining a pressurized air passageway 68 which has a rear intake opening 70 and a discharge opening 72 defined by a front nozzle insert 74. Fixedly connected to a midportion of the discharge stem 66 is a positioning piston 78 which has a peripheral seal which engages the interior surface 79 of the housing portion 22 that defines the secondary pressurizing chamber 34. This positioning piston 78 separates the secondary pressurizing chamber 34 into a forward high pressure section **34*a* and a rear low pressure section 34*b*, which opens to ambient atmosphere through an opening 81**.

The rear portion of the discharge stem 66 extends through an opening formed in the third rear wall 64 with a seal 80 being formed between the wall 62 and the stem 66. Also, the middle portion of the stem 66 extends through the first intermediate wall 60 and forms a seal 82 with the wall 60. A compression spring 84 surrounds the forward part of the discharge stem 66, with the rear end of the spring 84 pressing against the front intermediate wall 60, and with the forward end of the spring 84 pressing against a rearwardly facing shoulder of the nozzle insert 74 so as to urge the discharge stem 66 forwardly. The forward wall 58 of the housing 22 is formed with a front discharge opening (or port) 86 which the nozzle insert 74 of the stem 66 closes when the stem 66 is in a forward position in FIG. 2. However, when the stem 66 moves rearwardly against the urging of the compression spring 84, the forward end of the nozzle insert 74 is spaced from the discharge opening 86 to permit plaster in the supply chamber 30 to pass outwardly through the opening 86 as a spray, with the pressurized air flowing from the discharge opening 72 of the nozzle insert 74 causing the spray discharge of the plaster.

Figure 3:
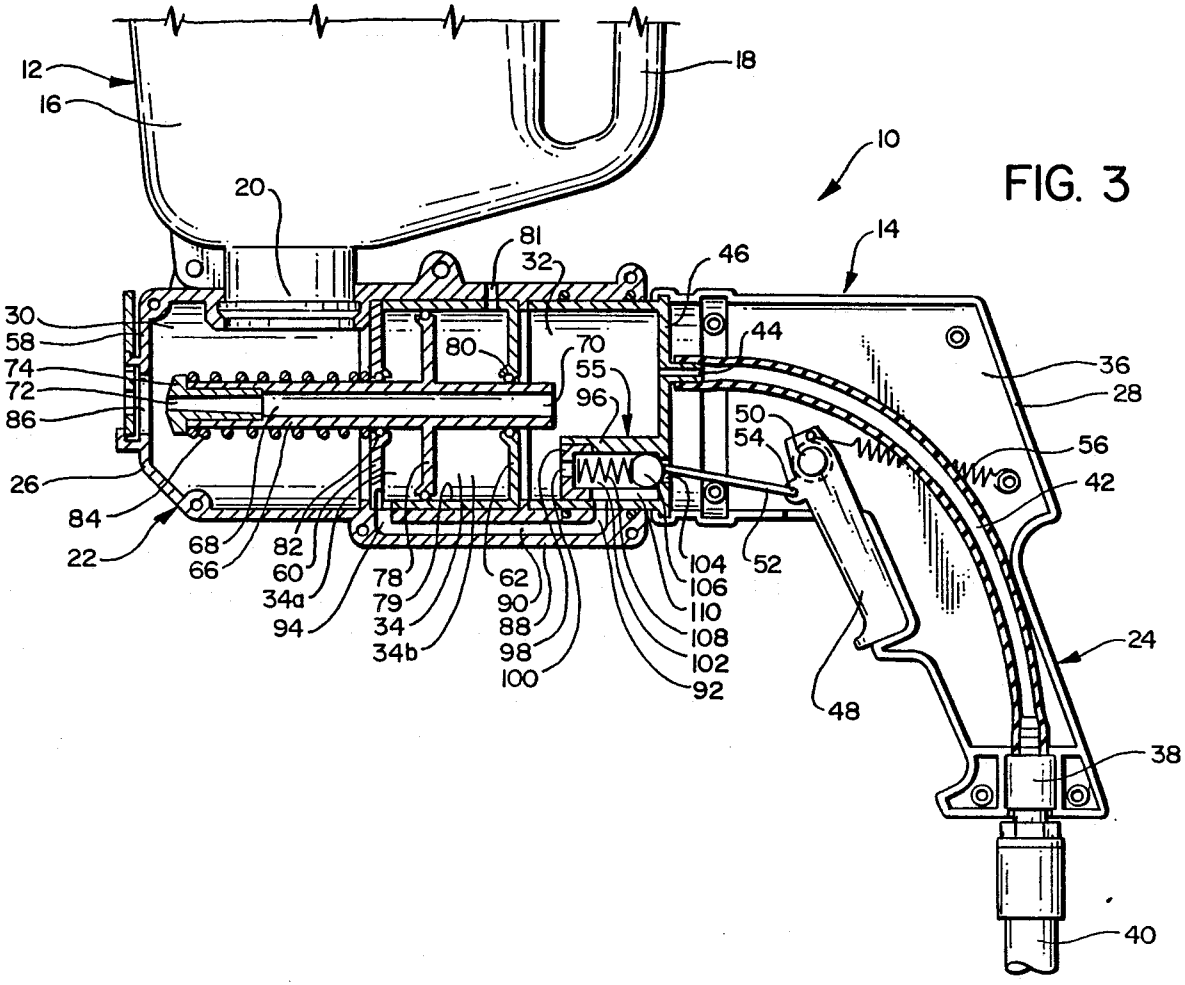
FIG. 3 is a view similar to FIG. 2, but showing the bypass passageway vented, and the valve stem in the seated position, so that the applicator is able to spray plaster or other fluid from the applicator.

To selectively move the stem 66 between its forward closed position FIG. 2 to its rear open position in FIG. 3, the housing 22 is formed with a side housing section 88 which defines a bypass passageway 90. The rear end 92 of the bypass passageway 90 communicates with the main pressurizing chamber 32 through the valve mechanism 55, while the forward end 94 of the bypass passageway 90 communicates with the forwardmost part of the pressurizing chamber 34.

As indicated previously, the valve mechanism 55 is a critical feature of the present invention. It can be seen that the valve mechanism 55 comprises an elongate closed housing 96 having a front wall 98 with a relatively small port or opening 100 leading from an interior area or chamber 102 of the housing 96 to the high pressure chamber 32. The rear wall of the housing 96 is formed by a portion of the aforementioned wall 46, and this has a port or opening 104 that leads into the operating chamber 36 and which is relatively large in cross-sectional area compared to the forward opening 100. There is a spherical valve element 106 in the housing chamber 102, and this is urged by a compression spring 108 rearwardly to close the opening 104. The aforementioned finger 52 that is attached to the trigger 48 extends into the opening 104.

The trigger 48 and the finger 52 are arranged so that when the trigger 48 is in the forward position of FIG. 2, the finger 52 pushes the valve element 106 away from its valve seat at the opening 104 against the urging of the compression spring 108. This connects the opening 104 to a vent passageway 110 that is formed in the housing 96 and which communicates with the inlet end 92 of the passageway 90. When the trigger 48 is pulled rearwardly to the position of FIG. 3, then the finger 52 retracts to permit the spring 108 to push the valve element 110 rearwardly to its closed position where the opening 104 is closed.

To describe the operation of the present invention, the storage bottle 12 is filled with the liquid which is to be dispensed as a spray, and which is simply referred to as plaster in this description (it being understood that other liquids could be dispensed other than plaster). Gravity flow causes the plaster to move into the front supply or containing chamber 30. With the discharge stem 66 in its closed position (as in FIG. 2), the plaster is simply held in the chamber 30. The air hose 40 is connected to a suitable supply of pressurized air, such as from a compressor (not shown).

When pressurized air is delivered through the hose 40 and through the air conduit 42, this pressurized air passes into the pressurizing chamber 32 and through the passageway 68 of the discharge stem 66. At the same time, pressurized air in the rear chamber 32 passes through the opening 100 toward the entrance 92 of the passageway 90. However, with the trigger 48 in its forward position (as shown in FIG. 2), much of this pressurized air is simply by-passed through the vent passageway 110 and through the vent opening 104 into the chamber 36 which is open to atmospheric pressure. Since the opening 104 has a relatively large cross-sectional area relative to the opening 100, the air pressure in the passageway 90 at most rises to a relatively low level, and the pressure in the forward chamber portion 34 does not rise to a sufficiently high level to cause the piston 78 to move rearwardly. Accordingly, the discharge stem 66 does not move away from the discharge port 86.

When the trigger 48 is retracted, this in turn retracts the pin 52 so that the valve element 106 is pushed rearwardly by the spring 108 to its closed position, as seen in FIG. 3, to close the port 104. This causes the pressurized air which flows from the chamber 32 into the opening 100 to be directed to the passageway 90 and into the forward portion **34*a* of the chamber 34*a* so as to pressurize the forward chamber portion 34*a*. When this air pressure reaches a predetermined level, the pressure in the forward secondary pressurizing chamber section 34*a* becomes sufficient to move the positioning piston 76 rearwardly against the urging of the compression spring 84. This in turn unseats the nozzle insert 74 from the discharge opening 86, to permit plaster (or other contained liquid) to flow into the area adjacent to the discharge port or opening 86 so as to be discharged as a spray due to the action of the air jet emitted from the nozzle 74**.

Then when the trigger 48 is released, the trigger 48 moves forwardly to cause the finger 52 also to move forwardly to move the valve element 106 away from its seat and open the vent opening 104. Pressurized air in the chamber portion 34*a* is caused to be vented to outside atmosphere through the passageway 90, thence through the vent passageway 110 and out the vent opening 104. Thus, even though the pressure in the chamber 32 remains at a relatively high level, the pressure in the forward chamber portion 34*a* is reduced to a level so that the pressure exerted on the positioning piston 76 is no longer sufficient to overcome the bias of the spring 84. This permits the stem 74 to move to its forward closed position of FIG. 2 to close the discharge port 86 from the plaster. The pressurized air passing into the conduit 42, into the chamber 32 and through the passageway 68 continues until the pressure source that delivers pressurized air to the conduit 40 is shut off.

As indicated previously, it has been found that the arrangement of the present invention particularly lends itself to the effective operation of preventing the aforementioned "dribbling."

The first embodiment described above is the preferred embodiment of the present invention, and the particular arrangement of the valve mechanism 55 offers certain advantages. For example, when the valve element 106 is in its closed position to close the venting port 104, the pressure in the valve chamber 102 operates to help maintain the valve element 106 in its closed position. This, along with the overall arrangement of the valve mechanism 55, enables the valve housing 96, the spring 108 and valve element 106 to be manufactured as relatively simple and inexpensive components. The following three embodiments are less preferred than the first embodiment.

Figure 4:
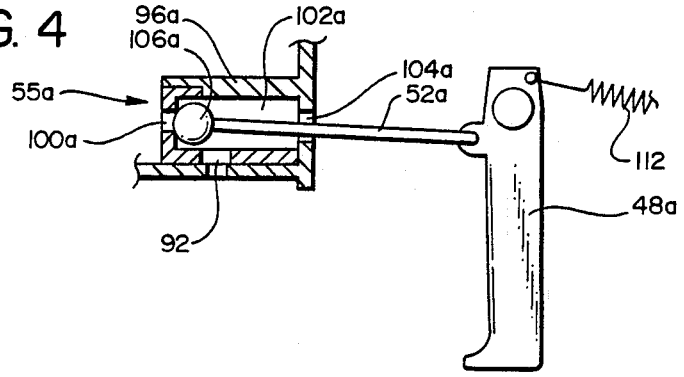
FIGS. 4,5, and 6 are partial sectional views of second, third and fourth embodiments of the valve mechanism incorporated in the present invention.

A second embodiment of the valve mechanism of the present invention is shown in FIG. 4. Components which are similar to components of the first embodiment of FIGS. 1 through 3 will be given like numerical designations, with an "a" suffix distinguishing those of the second embodiment. There is a valve mechanism 55*a* comprising a valve housing 96*a* having a first pressurizing port 100*a* and a second venting port 104*a*. The finger 52*a* extends into a chamber 102*a* defined by the housing 96*a*, and it is fixedly connected to a valve element 106*a*.

When the trigger 48*a* is in its forward position, the valve element 106*a* closes the pressurizing port 100*a*. When the trigger 48*a* is retracted against the urging of a tension spring 112 the valve element 106*a* is moved rearwardly to open the pressure port 100*a*. The pressure port 100*a* has a sufficiently large cross-sectional area relative to the venting port 102*a* that with the valve element 106*a* retracted from the port 100*a*, there is sufficiently pressurized air to flow through the bypass passageway 92 to pressurize the forward chamber and retract the stem 66.

Figure 5:
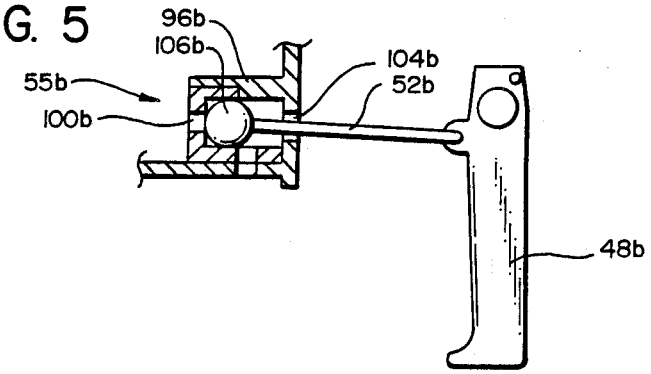

FIG. 5 shows a third embodiment of the valve mechanism, and "b" suffixes will be used to distinguish the components of this third embodiments which are similar to those of the first two embodiments.

This valve mechanism 55*b* of the third embodiment has the same overall configuration as the second embodiment of FIG. 2, except that the valve housing 96*b* has a sufficiently short axially length so that the valve element 106*b* in its forward position closes the forward pressurizing port 100*b*, and in its retracted position closes the venting port 104*b*.

Figure 6:
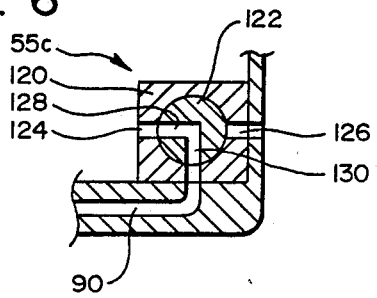

A fourth embodiment is shown in FIG. 6. The valve mechanism 55*c* comprises a valve housing 120 in which is positioned a cylindrical valve element 122. The housing 120 has a high pressure port 124 which connects to the main pressurizing chamber 32, and a venting port 126 which opens to atmospheric pressure in the rear operating chamber 36. There is a right angle passageway formed in the valve element 122, comprising a first right angle section 128 and a second right angle section 130. These connect to the bypass passageway 90, depending upon the position of the valve element 122. In the position of FIG. 6, the bypass passageway 90 is connected through the port 124 to the main pressurizing chamber 32. Then when the valve element 122 is rotated counterclockwise ninety degrees, the passageway section 128 comes into communication with the bypass passageway 90, and the passageway section 130 connects to the vent port 126, thus venting the bypass passageway 90.

It is believed that the operation of these three embodiments shown in FIGS. 4 through 6 is readily apparent from the previous description of the first embodiment, so no further detailed description of this will be included.

It is obvious that various modifications could be made to the present invention without departing from the basic teachings thereof.

What is claimed is:

1. A spray applicator to discharge a fluid material in a spray pattern by means of pressurized air, said applicator comprising:

a. a housing having a front end and a rear end, with said housing comprising:
   i. a front wall and a first intermediate wall positioned rearwardly of the front wall, and defining with said front wall a front fluid containing chamber, said front wall having a front discharge opening leading from the fluid containing chamber,
   ii. a second intermediate wall positioned rearwardly of said first intermediate wall, and defining with said first intermediate wall a secondary pressurizing chamber,
   iii. a third rear wall positioned rearwardly of said second intermediate wall, and defining therewith a main pressurizing chamber which is located rearwardly of said secondary pressurizing chamber;

b. a discharge stem defining a through air passageway and having a front outlet end and a rear inlet end, said discharge stem having a forward portion positioned in said containing chamber, and a rear portion extending through said first and second intermediate walls, in a manner so as to be moveable in a forward to rear direction;

c. a locating piston means being fixedly secured to said discharge stem and being positioned in said secondary pressurizing chamber so as to be moveable from a forward closure position at which the front end of the discharge stem closes the front discharge opening from the containing chamber, and a rear position where the front end of the discharge stem is spaced rearwardly of the outlet opening from the containing chamber;

d. a bypass passageway means having a first end leading from said main pressurizing chamber and a second end connecting to a forward portion of said secondary pressurizing chamber, whereby pressurized air in said main pressurizing chamber is able to flow through said bypass passageway into said secondary pressurizing chamber forwardly of said locating piston;

e. a spring means operatively connected between said discharge stem and said housing to urge said discharge stem forwardly into the closed position;

f. means to deliver pressurized air into said main pressurizing chamber;

g. said spring means, said locating piston, and said bypass passageway means being arranged in a manner that when a predetermined level of pressure is reached in said main pressurizing chamber, air pressure transmitted into said secondary pressurizing chamber forwardly of said locating piston is sufficient to overcome a force exerted by said spring means to cause said discharge stem to move rearwardly so that the forward end of the discharge stem moves away from the discharge opening leading from the containing chamber;

h. operator actuated pressure control valve means which is operatively connected to said bypass passageway means and to said main pressurizing chamber, said valve means having a first position by which pressurized air flows from said main pressurizing chamber, through said bypass passageway means and to the forward portion of the secondary pressurizing chamber to cause the discharge stem to move rearwardly and by which said pressurized air flows from said main pressurizing chamber through said air passageway of the discharge stem, and a second position where air in the forward portion of the secondary pressurizing chamber is vented to reduce pressure in said forward portion, while any flow from said main pressurizing chamber is sufficiently limited so that a pressure level in said main pressurizing chamber is sufficiently high to maintain said flow of pressurized air through the discharge stem;

whereby when pressurized air flows into said pressurizing chamber, with said valve means in said first position, there is an immediate outflow of air through said air passageway in the discharge stem, and also pressurized air flows through said valve means and through said bypass passageway into the forward portion of the secondary pressurizing chamber and reaches a level to cause rearward movement of said locating piston and said stem, so as to permit fluid in said containing chamber to pass into an airstream passing from said discharge stem and be discharged into the airstream through the discharge opening, and when said valve means is moved to said second position, air is vented from the forward portion of said secondary pressurizing chamber so as to reduce pressure in said forward portion so that said locating piston and said discharge stem move forwardly so that the front end of the discharge stem closes the front discharge opening from the containing chamber while pressurized air continues to flow from said main pressurizing chamber through said discharge stem and out the front outlet end of the stem.

2. The applicator as recited in claim 1, wherein said pressure control valve means comprises first pressurizing port means leading from said main pressurizing chamber to said bypass passageway means, and also comprising second vent port means leading from said bypass passageway means to a venting location.

3. The applicator as recited in claim 2, wherein said valve means comprises a valve element means having a first closed position relative to said vent port to prevent pressurized air from said bypass passageway means passing outwardly through said vent port means, and a second position opening said vent port means to said venting location to permit pressurized air to flow from said bypass passageway means to said venting location.

4. The applicator as recited in claim 3, wherein said pressurizing port means has a smaller cross-sectional flow area relative to said vent port means, with said pressurizing port means and said vent port means communicating with a valve chamber having a flow connection with said bypass passageway means, whereby with the valve element means being in the second position, outflow through said vent port means is able to exceed inflow through said pressurizing port means so that pressure in said valve chamber is reduced.

5. The applicator as recited in claim 1, wherein said valve means comprises a valve housing defining a valve chamber having a flow connection with said bypass passageway means, a first port of a relatively smaller cross-sectional area opening between said valve chamber to said pressurizing chamber, and a second port means of a relatively larger diameter connecting from said valve chamber to a venting location, a valve element means having a first closed position closing said second port means whereby pressurized air flowing from said main pressurizing chamber into said valve chamber flows through said bypass passageway means to pressurize the forward portion of said secondary pressurizing chamber, and with said valve element means in a second position opening said second port means, pressurized air flowing into said valve chamber through said first port means or from said bypass passageway means is vented to said venting location to reduce pressure in said valve chamber and thus reduce pressure in the forward portion of the secondary pressurizing chamber.

6. The applicator as recited in claim 5, wherein said second port means opens to ambient atmosphere.

7. The applicator as recited in claim 5, wherein there is a manually operated trigger means which is moveable between first and second trigger positions, with said trigger means in its first position engaging said valve element means to move said valve element means to its second open position and with the trigger means in its second position, said valve element is permitted to move to its first closing position.

8. The applicator as recited in claim 1, wherein said valve means comprises a valve housing defining a valve chamber, said valve housing having a first port connecting between said main pressurizing chamber and said valve chamber, and a second port connecting from said valve chamber to said venting location, a valve element means having a first position closing said first port, and a second position opening said first port.

9. The valve as recited in claim 1, wherein said valve element means also has a second position closing said second port.

10. The applicator as recited in claim 1, wherein said valve comprises a valve housing and a moveable valve element in said housing, said moveable valve element having a first position connecting said bypass passageway means to a first port communicating with said main pressurizing chamber, and a second position connecting said bypass passageway means with a second port leading to a venting location.

* * * * *